US007334616B2

(12) United States Patent
Kaminski

(10) Patent No.: US 7,334,616 B2
(45) Date of Patent: Feb. 26, 2008

(54) CARD-HOLDING AND MONEY CLIP DEVICE

(76) Inventor: Scott T. Kaminski, 12919 Alcosta Blvd., San Ramon, CA (US) 94583

( * ) Notice: Subject to any disclaimer, the term of this patent is extended or adjusted under 35 U.S.C. 154(b) by 134 days.

(21) Appl. No.: 10/963,032

(22) Filed: Oct. 12, 2004

(65) Prior Publication Data

US 2006/0076094 A1 Apr. 13, 2006

(51) Int. Cl.
*A45C 11/18* (2006.01)

(52) U.S. Cl. ..... 150/147; 206/38; 206/39.5; 24/3.12

(58) Field of Classification Search ..... 150/147, 150/148, 149; 24/3.12; 206/38, 39, 39.5; 40/658

See application file for complete search history.

(56) References Cited

U.S. PATENT DOCUMENTS 1,040,051 A * 10/1912 Swihart ..... 206/39.5
1,851,013 A * 3/1932 Michaud et al. ..... 24/67.11
4,141,400 A * 2/1979 Mangan ..... 206/39.6
4,323,879 A * 4/1982 Kelley ..... 340/321
4,915,215 A * 4/1990 Brekke ..... 206/39
4,918,299 A * 4/1990 Ohmori ..... 235/488
5,592,767 A * 1/1997 Treske ..... 40/649
5,718,329 A * 2/1998 Ippolito et al. ..... 206/38
D393,813 S * 4/1998 Herdt ..... D11/78.1
6,082,581 A * 7/2000 Anderson et al. ..... 221/232
6,427,837 B1 * 8/2002 Shields ..... 206/449
6,823,910 B1 * 11/2004 Elnekaveh ..... 150/147
2003/0217936 A1 * 11/2003 Nourian ..... 206/39

FOREIGN PATENT DOCUMENTS

EP 0251900 A1 * 1/1988
EP 0677257 A1 * 10/1995
FR 2654081 A1 * 5/1991

* cited by examiner

*Primary Examiner*—Sue A. Weaver

(57) ABSTRACT

A combination money clip and card holder adapted to retain paper currency and to removably store flexible cards such as credit cards. The product is constructed of three extrudeable plastic material parts that are easily assembled to produce a durable, smooth exterior surface. The product is light weight and of a size to be conveniently carried in a pocket or purse.

17 Claims, 5 Drawing Sheets

CARD-HOLDING AND MONEY CLIP DEVICE

STATEMENT REGARDING FEDERALLY-SPONSERED RESEARCH OR DEVELOPMENT

Not Applicable

REFERENCE TO MICROFICHE APPENDIX

Not Applicable

BACKGROUND OF THE INVENTION

This invention relates to a device for holding paper currency and cards, such as business cards and conventional credit cards. More particularly, the invention relates to a combination card holder and money clip adapted to retain paper currency as well as removably store flexible cards, e.g., credit cards, and sized to be conveniently carried in a pocket or purse. Furthermore, the device of the present invention is constructed of extrudeable plastic materials that can be joined to produce a smooth exterior surface while providing a durable assembly. The device of the present invention comprises three elements that are easily assembled to produce the durable product.

Prior-art holders for paper currency and cards are disclosed in U.S. Pat. Nos. 5,358,019 and 5,520,230 to Sumner III and my U.S. Pat. No. 6,082,422, all in metal construction. Some prior-art holders have been constructed of extrudable or castable plastic materials, but none have the simplicity of construction or ease of assembly of the present invention. The prior-art plastic holders are of designs that do not permit easy access to the interior of the holder while providing the needed rigidity to hold currency.

BRIEF SUMMARY OF THE INVENTION

It is accordingly desirable to provide a combination money clip and card holder that is inexpensive to construct and that includes means for removably retaining paper currency and cards therein.

It is further desirable to provide a card-holder and money clip that is light weight, durable and comfortable to carry in a pocket or purse.

Further, it is desirable to provide a holder that may be constructed of an injectable plastic material that has desired rigidity and flexibility to perform its desired duties.

It is further desirable to provide a card-holder and money clip that is assembled from a minimum of parts in an easy assembly process.

Further advantages of the invention will become apparent from consideration of the ensuing description and the accompanying drawings.

In one embodiment of the invention , the combination card-holder and money clip comprises a first panel element and a second panel element and a resilient article retaining member or money clip element. The money clip element has a portion that extends through a slot in the first panel and has a portion secured within the first panel and a portion extending along the surface of the first panel. The two panels are joined together by suitable methods, to be described, to produce a single structure card-holder and money clip device with an interior cavity easily accessible for inserting and withdrawing cards. The exterior surfaces of the assembly are rounded and smooth to prevent snagging to a surface when in use. The interior cavity of the assembly includes a resilient element for releasable retaining cards inserted into the cavity.

BRIEF DESCRIPTION OF THE SEVERAL VIEWS OF THE DRAWINGS

The present invention is illustrated by way of example, and not by way of limitation, in the figures of the accompanying drawings, where.

Figure 1:
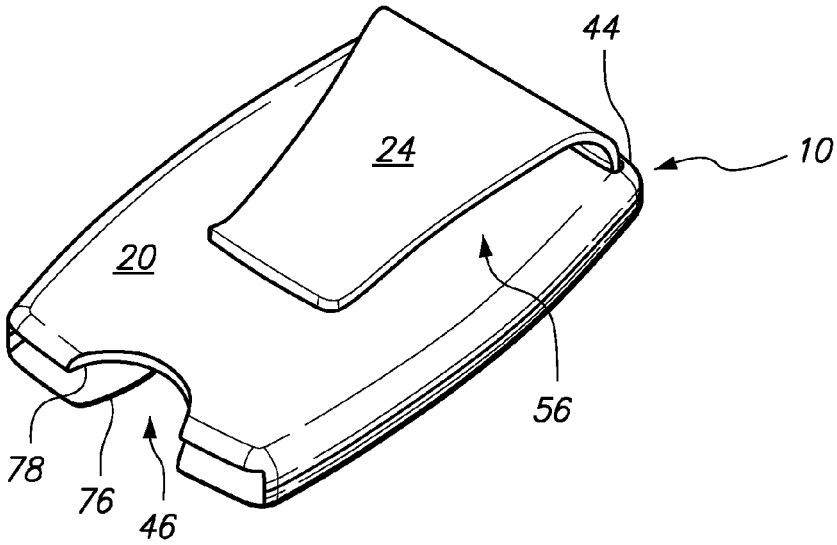
FIG. 1 is a perspective view of the assembled card-holder and money clip device.

LIST OF NUMERALS AND ELEMENTS THROUGHOUT THE SPECIFICATION holder assembly 10
first panel 20
second panel 22
money clip 24
lip 30 in panel 20
alignment holes 31
lip 32 in panel 22
alignment tabs 33
longitudinal elements 34*a* and 36*a* of panel 20
longitudinal elements 34*b* and 36*b* of panel 22
lateral element 38*a* of panel 20
lateral element 38*b* of panel 22
"U" shaped mating surface 40*a* of panel 20
"U" shaped mating surface 40*b* of panel 22
structural openings 41*a* of panel 20
structural openings 41*b* of panel 22
lateral ribs 42*a* of panel 20
lateral ribs 42*b* of panel 22
longitudinal elements 34*b* and 36*b*
enclosure closed end 44
enclosure open end 46
money clip curved proximal end 50
money clip substantially flat midsection 52
money clip bowed distal end 54
surface 56 of first panel 20
retaining channel 64
retaining channels 64*a* and 64*b*
money clip tab 66
money clip shoulder 68
card retainer 70 card retainer slot 72
surface 74
cutout portion 78 (panel 20)
cutout portion 76 (panel 22)

DETAILED DESCRIPTION OF THE INVENTION

Throughout the following description, specific details are set forth in order to provide a more thorough understanding of the invention. However, the invention may be practiced without these particulars. In other instances, well-known elements have not been shown or described to avoid unnecessarily obscuring the present invention. Accordingly, the specification and drawings are to be regarded in an illustrative, rather than a restrictive, sense.

FIG. 1 illustrates, in perspective, the assembled embodiment of the combination card-holder and money clip. Holder assembly 10 consists of parts which preferably are either injection molded or cast: a nominally rectangular first panel 20, a nominally rectangular second panel 22, and a resilient article retaining element or money clip 24.

Figure 2:
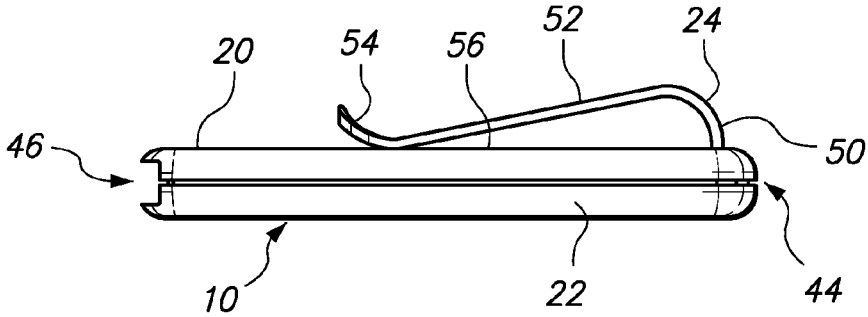
FIG. 2 is a side view of the assembled device.

FIG. 2 illustrates a side view of the assembled device 10 shown in perspective in FIG. 1 and shows the money clip 24 extending from the first panel 20 and the second panel 22 below the assembled device.

Figure 3:
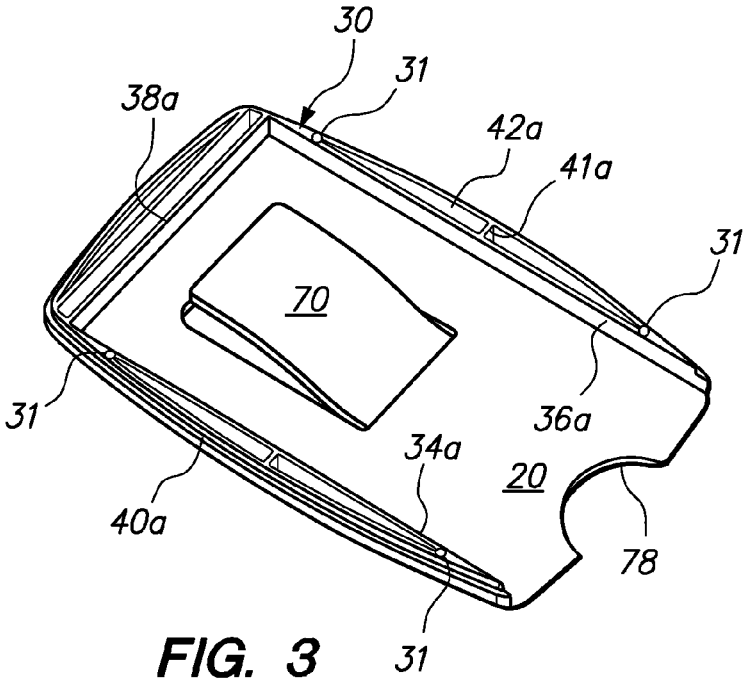
FIG. 3 is a perspective view of the interior of the first panel of the device.

FIG. 3 illustrates, in perspective, the interior of the first panel 20 having a lip 30 which extends along three sides at right angles from the plane of panel 20 (nominally about 0.125 inch) forming a cavity. Lip 30 consists parially of three continuous and nominally straight sections: two longitudinal elements 34*a* and 36*a*, and a lateral element 38*a*. Lip 30 is bounded by a "U" shaped mating surface 40*a* around the periphery of panel 20.

Figure 4:
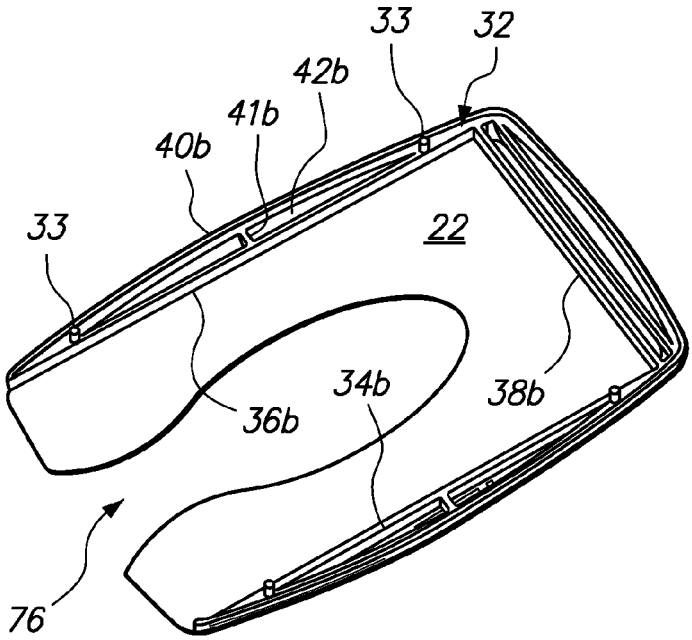
FIG. 4 is a perspective view of the interior of the second panel of the device.
Figure 5:
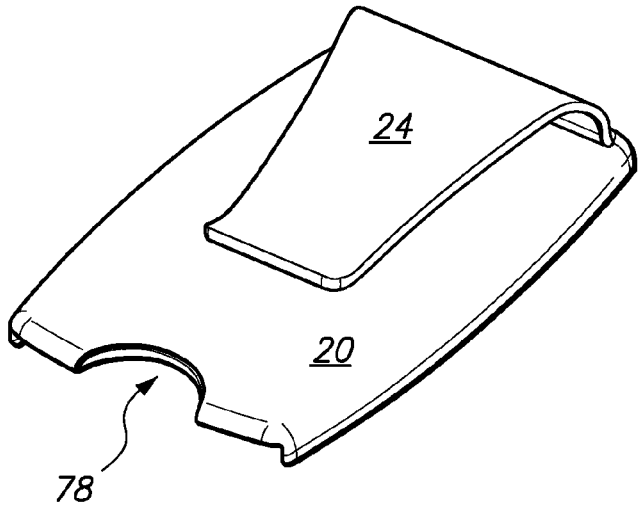
FIG. 5 is a perspective view of the exterior surface of the first panel with the money clip extending from its interior.
Figure 6:
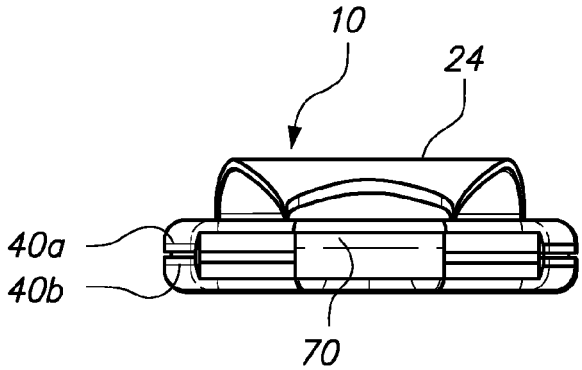
FIG. 6 is a bottom end view of the assembled device.
Figure 7:
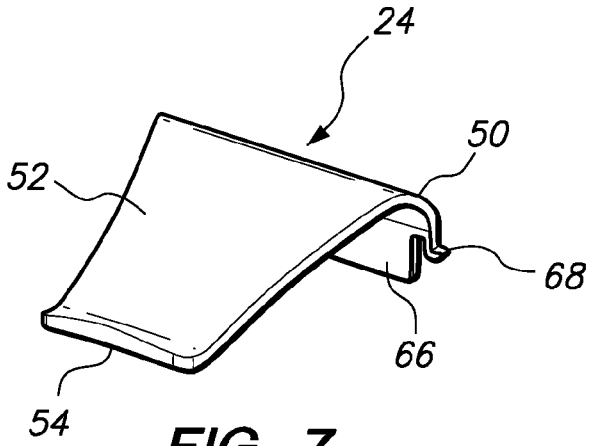
FIG. 7 is a perspective view of the money clip element.
Figure 8:
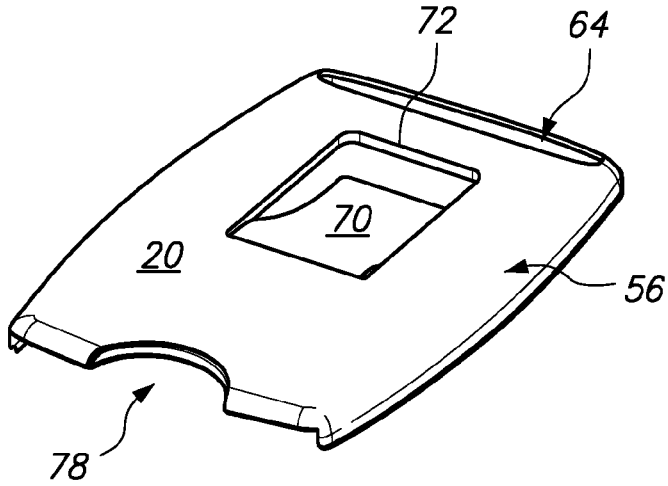
FIG. 8 is a perspective view of the exterior surface of first panel of the device.

FIG. 4 shows, in perspective, the interior of the second panel 22 having a similar lip 32 along three sides, comprising two longitudinal elements 34*b* and 36*b*, a lateral element 38*b*, and a "U" shaped mating surface 40*b* around the periphery of the panel 22. Mating surface 40*b* conforms with mating surface 40*a*, as described below.

The lips 30 and 32 are formed with structural openings (41*a* and 41*b*) and lateral ribs (41*a* and 41*b*) to provide strength with reduced weight and to form the mating surfaces. The mating surfaces are smooth and parallel so as to substantially completely align the mating surfaces 40*a* and 40*b* on the opposite panels.

Alignment holes 31 are provided along lip 30 of the first panel 20 and alignment tabs 33 are provided along the lip 32 of the second panel 22. The holes 31 and the tabs 33 are mated with each other to align mating surfaces 40*b* with mating surface 40*a*.

It should be understood that the money clip 24 may be a separate part or can be molded with the formation of panel 20. For ease of formation and assembly the separate part form is preferred.

FIGS. 1, 2, 6 and 10 shows panels 20 and 22 attached at mating surfaces 40*a* and 40*b* and bonded together as by glue, ultrasonic or electromagnetic welding or the like. The resulting assembled enclosure 10 can be seen to be nominally rectangular with one closed end 44 and one open end 46. The interior dimensions of assembled enclosure 10 are of a predetermined size to accommodate rigid cards such as plastic credit cards, paper business cards, and the like, such cards being inserted and removed through open end 46.

FIGS. 1, 2, 5, 6 and 10 further show a money clip 24 extending from one end of first panel 20 and disposed to rest substantially along the center of panel 20. Clip 24 is a resilient member, as shown in FIG. 2, having a curved proximal end 50, a substantially flat midsection 52, and a bowed distal end 54. Proximal end 50 is formed so as to bias clip 24 toward surface 56 of panel 20, whereby flexible articles, such as, foldable paper currency (not shown) can be secured between distal end 54 and surface 56.

Figure 10:
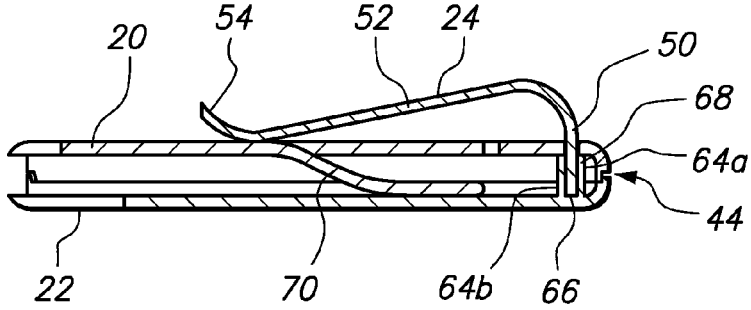
FIG. 10 is a sectional view taken along the lines 10-10 of FIG. 11.
Figure 11:
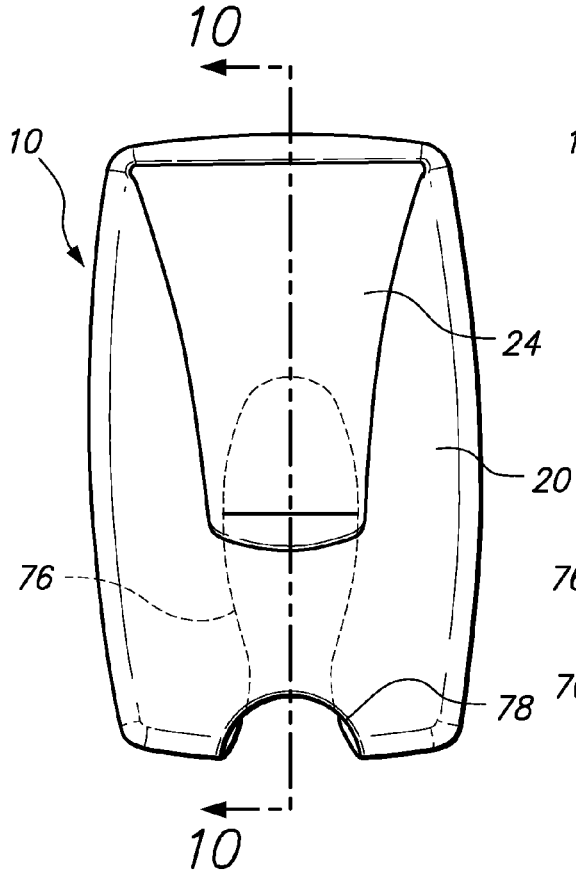
FIG. 11 is a front elevation view of the assembled device showing the money clip side of the device.

Two embodiments of money clip are described. FIG. 10 is a cross section of the assembly and showing money clip 24 integrally molded. Money clip 24 could be formed and with and extending from panel 20 or, money clip 24 can be a separately formed element. Money clip proximal end 50 attaches to the enclosure closed end 44, the stronger end. The resilience required to bias money clip 24 toward the panel is derived from the rigidity and memory of the plastic material, using known plastic molding techniques.

FIGS. 7, 8, 9 and 10 show an embodiment in which money clip 24 is a separate element secured to the holder 10 by a retaining channel 64 molded into the first panel 20. Retaining channels 64*a* and 64*b* may be molded into each of panels 20 and 22. In FIGS. 7, 8, 9 and 10 retaining channel 64*a* in panel 20 and 64*b* in panel 22 are molded into the panels during their formation and are configured to be in alignment and to retain mating money clip tab 66 adjacent to the proximal end 50. This configuration increases retention area and provides additional strength to resist bending forces in money clip 24.

In the separate configuration, money clip 24 is added to the assembly as follows: Prior to joining the panels 20 and 22 of the enclosure, clip distal end 54 is inserted through the retainer channel 64 in first panel 20 and pulled through the slot until tab 66 engages in channel 64*a* and shoulder 68 engages the interior of the panel at the channel edge. Panels 20 and 22 are then brought together, engaging tab 66 in channel 64*b*. Finally, panels 20 and 22 are joined as by being glued or welded together.

As shown in FIGS. 3, 6, 8 and 10 first panel 20 has an integrally formed card retaining member 70 for retaining cards (not shown) within assembled enclosure 10. Card retainer 70 is an integral resilient member defined by a "U" shaped slot 72 in first panel 20 and is biased toward second panel 22, whereby cards can be secured between retainer 70 and surface 74 on the interior of panel 22. The retainer 70 is formed with sufficient retention bias force to keep cards from falling out of enclosure 10 and is moderately curved and flexible to accommodate a varying number of cards and to provide a uniform sliding resistance as cards are removed or inserted.

Figure 9:
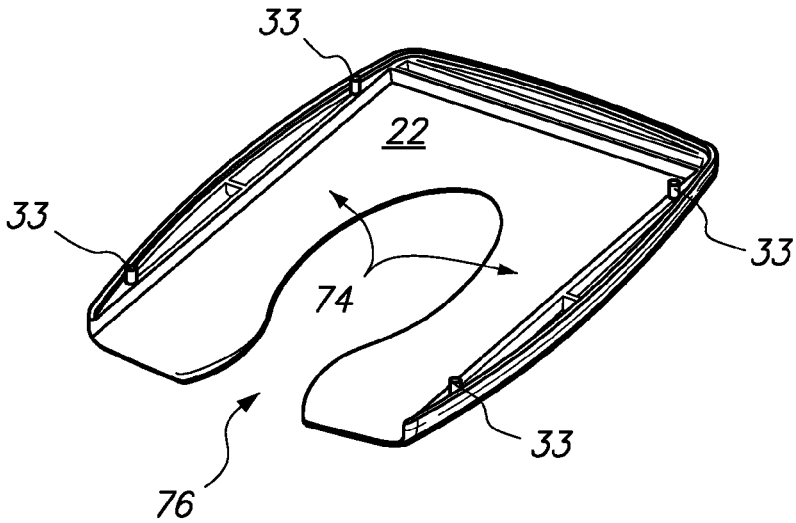
FIG. 9 is a perspective view of the interior of the second panel of the device showing the contours and elements for connection to the first panel.

FIGS. 1, 4 and 9 show a cutout portion 76 in panel 22 and FIGS. 1, 3, 5 and 8 show a smaller cutout portion 78 in panel 20. These two cutout portions 76 and 78 provide access to cards held within the interior of the assembled device 10. The cutout 76 in panel 22 is larger to permit viewing of a surface of an outermost card within the device 10 and for finger contact in removing an outermost card. The cutout 78 in panel 20 permits adequate finger contact with an outermost card within the device to provide for ease of removal of such a card from the device the open end.

Figure 12:
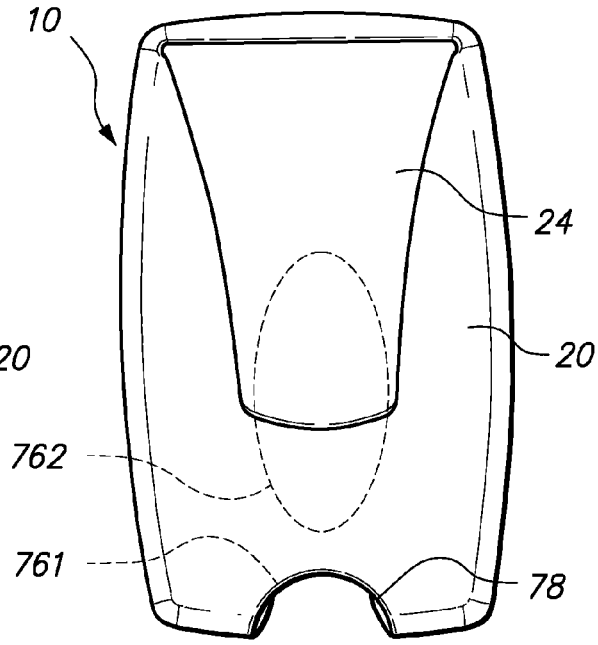
FIG. 12 is a front elevation of an alternative configuration of the first panel of the device.
Figure 13:
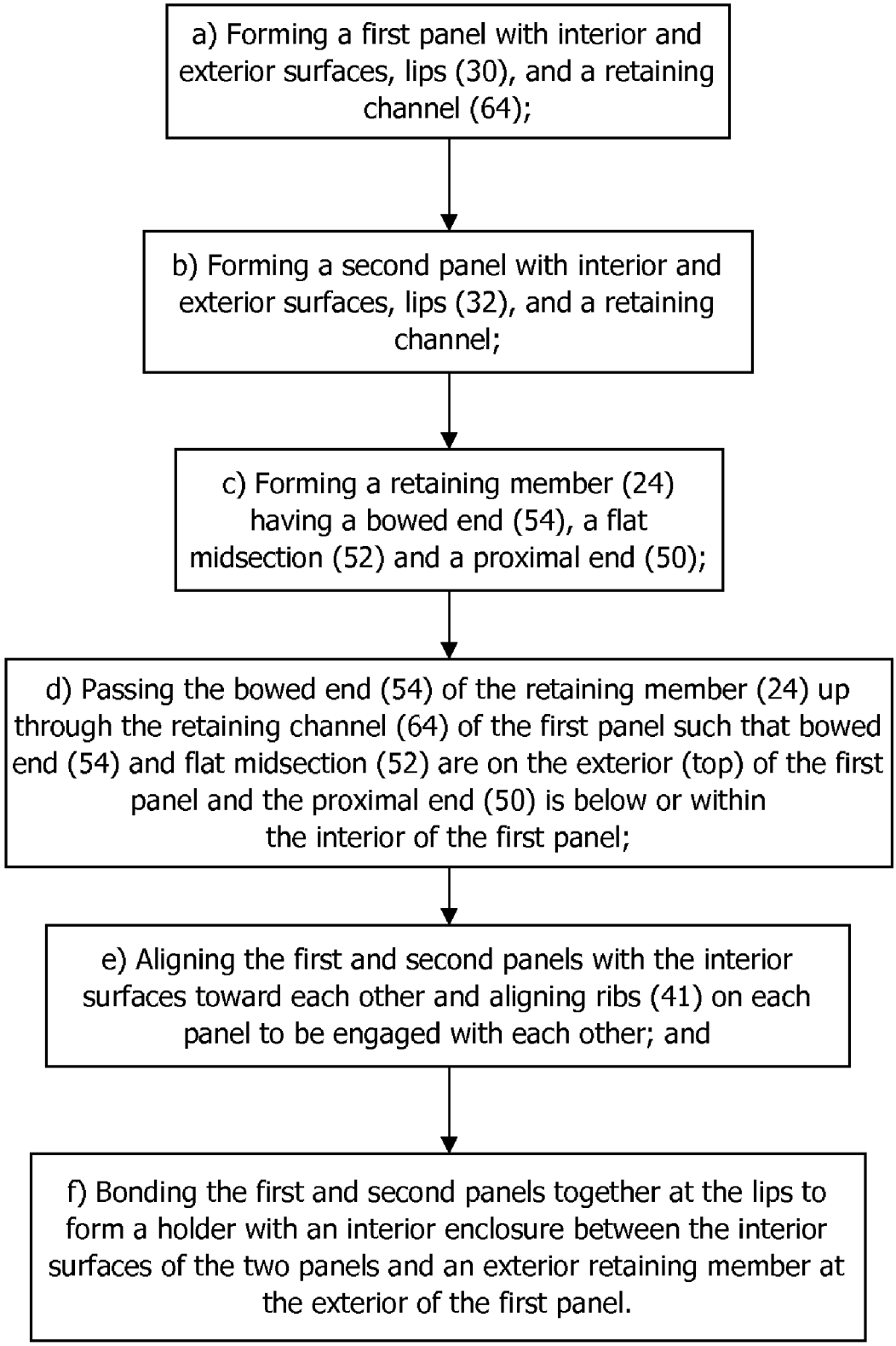
FIG. 13 shows the steps of assembling the holder.

An alternative form for the panel 22 is shown in FIG. 12 where the cutout 761 is a substantial duplicate of the cutout 78 in panel 20 and the portion of the cutout 762 for viewing an outermost card retained in the assembled holder and for permitting finger contact with the surface of a card to assist in removal of a card at the open end of the assembly.

The perspective figures show lips 30 and 32 having varying thickness defining the outer dimension of enclosure 10. It should be evident the exterior surfaces of the device 10, in panels 20 and 22 and in the money clip 24 are rounded to provide a smooth exterior surface. Also, the ends and sides of the device are comfortably rounded to provide an esthetic appearance and a comfortable feel when the card-holding and money clip device 10 is used.

While certain preferred embodiments of the invention have been specifically disclose, it should be understood that the invention is not limited thereto as many variations will be readily apparent to those skilled in the art and the invention is to be given its broadest possible interpretation within the terms of the following claims.

What is claimed is:

1. A holder for securely and simultaneously retaining flexible articles and rigid cards, said holder comprising: a) a nominally rectangular and nominally flat planar first panel having interior and exterior surfaces, a lip extending nominally around three edges of said first panel along said interior surfaces, said lip being at right angles to the plane of said first panel; b) a nominally rectangular and nominally flat planar second panel having interior and exterior surfaces, a lip extending nominally around three edges of said second panel along said interior surface and configured to form a mirror image of said first panel, said second panel being adapted to be attached to said first panel along said three edges to form an open-ended enclosure of sufficient size to store said rigid cards within said interior of said enclosure, said enclosure being nominally rectangular with two longitudinal sides, an open end, and a closed end; c) a resilient article retaining member having an attached end and a free end extending from one end of said enclosure and over the exterior of said first panel, said free end of said article retaining member being biased toward said exterior surface of said first panel; wherein said first panel and said second panel each has lips of varying thickness.

2. The holder of claim 1 wherein said first panel has an integrally formed resilient card retaining member for removeably holding rigid cards within said holder, said card retaining member having an end attached to said first panel and a free end, said free end being biased toward said interior surface of said second panel.

3. The holder of claim 1 wherein, said lips of said first and second panels being adapted to engage and be secured to each other to form said enclosure, said enclosure being substantially rectangular with straight joined inner edges along three sides, the outer surface of said holder formed by said panels having rounded edges and smooth exterior surfaces.

4. The holder of claim 1 wherein said first panel and said second panel have cutouts along an edge forming said open end to facilitate insertion and removal of rigid cards, said cutouts extending from said open end and toward the interior of said enclosure.

5. The holder of claim 1 wherein said first panel and said second panel have cutouts to facilitate insertion and removal of said rigid cards, said cutout in said second panel being of sufficient length and width to allow viewing a substantial part of an outermost rigid card when retained within said enclosure and to allow removal of said outermost rigid card by sliding said card along the length of said cutout toward said open end.

6. The holder of claim 1 wherein said resilient article retaining member is integrally formed with said first panel.

7. The holder of claim 6 wherein said integrally formed article retaining member has a portion extending from said interior of said first panel, said integrally formed article retaining member having an interior portion engaging a cutout portion in said interior of said second panel.

8. The holder of claim 7 wherein said first panel includes a retaining channel for passage of said flat midsection and distal end from said first panel and for retaining said proximal end within said interior of said first panel.

9. The holder of claim 8 wherein said interior surface of said second panel includes a retaining channel aligned with said retaining channel in said first panel, said proximal end of said retaining member including an extension that mates with said retaining channel in said interior of said second panel.

10. The holder of claim 8 wherein said proximal end of said retaining member includes a shoulder, said shoulder engaging the interior surface of said retaining channel in said first panel to limit passage of said proximal end through said retaining channel, said retaining channel permitting passage of said flat midsection and said bowed distal end from the interior of said first panel to the exterior thereof.

11. The holder of claim 1 wherein said resilient article retaining member is separately formed, with a proximal end, a substantially flat midsection and a bowed distal end, said distal end extending from the exterior of said first panel, said midsection extending along and spaced from the exterior of said first panel, said bowed distal end extending outwardly from said first panel, said resilience of said retaining member causing said flat midsection and bowed distal end to be biased toward said exterior of said first panel.

12. A holder for securely and simultaneously retaining foldable articles and rigid cards, said holder comprising: a) a first panel comprising a concave first wall bonded to a second panel comprising a concave second wall forming a cavity, said cavity being nominally rectangular and having two longitudinal sides, an open end and a closed end, said cavity being of predetermined size to store rigid cards, said cards being inserted into and removed from said holder through said open end, b) a resilient article retaining member extending from the exterior of and at one end of said first panel and over said first panel, said article retaining member being biased toward said exterior of said first panel.

13. The holder of claim 12 wherein said first panel and said second panel have cutouts to facilitate insertion and removal of said rigid cards, said cutout in said second panel being of sufficient length and width to allow viewing a substantial part of an outermost rigid card when retained within said enclosure and to allow removal of said outermost rigid card by sliding said card along the length of said cutout toward said open end.

14. The holder of claim 12 wherein said first panel includes an integrally formed resilient card retaining member, said card retaining member being biased toward the interior of said second panel.

15. The holder of claim 12 wherein the outside surface of said holder has rounded edges for avoiding snagging and tearing of surrounding materials.

16. The holder of claim 12 wherein said first panel and said second panel includes cutouts to facilitate insertion and removal of rigid cards, said cutouts extending from said open end of said cavity.

17. A method of forming a holder for securely and simultaneously retaining flexible articles and rigid cards comprising the steps of: a) forming a first panel with interior and exterior surfaces, lips extending from the interior surface of said first panel, a retaining channel, said lips having flat surfaces along three sides of said first panel; b) forming a second panel with interior and exterior surfaces, lips extending from the interior surface of said second panel, said lips having flat surfaces along three sides of said second panel; c) forming a resilient retaining member having a bowed end, a flat midsection and a proximal end; d) passing said retaining member through said retaining channel in said first panel with said bowed distal end and flat midsection extending to the exterior of said first panel and with said proximal end within the interior of said first panel; e) aligning said first and second panels with said interior surfaces toward each other and aligning said lips on each panel to be engaged with each other; f) bonding said first and second panels together at said lips to form said holder with an interior enclosure between the interior surfaces of said panels and an exterior retaining member at the exterior of said first panel.

* * * * *